US007559663B2

(12) United States Patent
Wong et al.

(10) Patent No.: US 7,559,663 B2
(45) Date of Patent: Jul. 14, 2009

(54) LIGHTING DEVICE

(76) Inventors: Wai Kai Wong, Flat A 28/F Broad View Villa, 20 Borad Wood Road, Hong Kong (CN); Kwok Ying Chow, Flat 9A, Block 3, Pristine Ville, Shatin, Hong Kong (CN); Kui Hang Wong, Flat 3002, Kam Hing House, Kam Tai Court, Ma On Shan, Shatin, N.T., Hong Kong (CN)

( * ) Notice: Subject to any disclaimer, the term of this patent is extended or adjusted under 35 U.S.C. 154(b) by 122 days.

(21) Appl. No.: 11/719,077

(22) PCT Filed: Oct. 24, 2005

(86) PCT No.: PCT/CN2005/001759

§ 371 (c)(1),
(2), (4) Date: May 10, 2007

(87) PCT Pub. No.: WO2006/056120

PCT Pub. Date: Jun. 1, 2006

(65) Prior Publication Data

US 2008/0186698 A1 Aug. 7, 2008

(30) Foreign Application Priority Data

Nov. 29, 2004 (CN) ..... 2004 1 0052415
May 23, 2005 (CN) ..... 2005 2 0058479 U

(51) Int. Cl.
*F21V 21/30* (2006.01)

(52) U.S. Cl. ..... 362/35; 362/269

(58) Field of Classification Search ..... 362/35, 362/166, 170, 269, 271, 275–287, 479, 500, 362/540, 545, 780, 800, 806; 40/480, 484, 40/493, 495, 516
See application file for complete search history.

(56) References Cited

U.S. PATENT DOCUMENTS

| | | | | |
|---|---|---|---|---|
| 4,353,110 | A * | 10/1982 | Ellis | 362/35 |
| 5,084,803 | A | 1/1992 | Lan | |
| 5,091,828 | A * | 2/1992 | Jincks et al. | 362/542 |
| 5,269,719 | A * | 12/1993 | Klawitter et al. | 446/485 |
| 6,283,603 | B1 | 9/2001 | Lin | |
| 6,505,576 | B2 * | 1/2003 | Nathanson et al. | 119/702 |
| 6,601,979 | B1 * | 8/2003 | Byrd et al. | 362/500 |
| 6,874,909 | B2 * | 4/2005 | Vanderschuit | 362/232 |
| 2003/0223243 | A1 * | 12/2003 | Miller | 362/487 |
| 2004/0004828 | A1 * | 1/2004 | Chernick et al. | 362/35 |

* cited by examiner

*Primary Examiner*—Hargobind S Sawhney
(74) *Attorney, Agent, or Firm*—Sutherland Asbill & Brennan LLP

(57) ABSTRACT

A lighting device provides with a mechanism which rotates, oscillates or rolls a lighting unit, and includes a power source (1), a trigger (2), a lighting unit (3) and a motor (4), wherein the power source (1) supplies power to the lighting unit (3) and the motor (4) via the trigger (2). The lighting device further includes a control unit which is connected in parallel to the lighting device. By changing internal circuits of the control unit, a pins which connects to an energy storage element is set, therefore the lighting unit flashes in a predetermined sequence after interruption of power is resumed, and the lighting unit moves in a certain track, occurring a path in which position of light spots changed.

20 Claims, 6 Drawing Sheets

LIGHTING DEVICE

RELATED APPLICATIONS

This invention relates to a kind of lighting device and particularly to a lighting device which makes the lighting unit to generate a mechanism whose physical location is alterable.

BACKGROUND OF THE INVENTION

Lighting devices are usually fixed on goods such as footwear and clothing to bring a decoration effect; moreover, at night, the flashing can remind the drivers to notice the pedestrian who wears a lighting device, so as to ensure these pedestrians in safety. The existing lighting device, as shown in FIG. 1, comprising a power source, a trigger and a lighting unit; the power source supplies power to the lighting unit via the trigger. By controlling the trigger, it can make the mentioned lighting unit lightening in a prearranged mode. However, because the lighting unit is set in a settled position and cannot move, the existing lighting device only can emit the lighting effect at one certain position, it may lead the lighting effect to be very monotone and uninteresting.

SUMMARY OF THE INVENTION

In order to solve the above defects, the purpose of this invention is to provide a lighting device, wherein the position of the lighting unit can be changed in a certain area around one predetermined position; the further purpose of this invention is to provide a lighting unit, besides the function of that its position can be changed in a certain area around one predetermined position, it can also flash in a predetermined sequence after interruption of power source is resumed, so to make the lighting unit to generate more lighting effect and to increase its attraction.

The lighting device which provided by this invention, comprising a power source 1, a trigger 2 and a lighting unit 3, wherein the power source 1 supplies power to the lighting unit 3 via the trigger 2. This lighting device also includes a mechanism which rotates, oscillates or rolls the lighting unit 3.

The mentioned mechanism which rotates the lighting unit includes a motor 4, referring to FIG. 3, FIG. 5 and FIG. 7, the motor 4 possesses a rotating shaft 5 connected to the lighting unit 3 or the partial lighting unit, the mentioned lighting unit 3 has a control unit connected to it.

The mentioned mechanism which oscillates the lighting unit includes a swinging device 10 with an oscillating shaft 9, referring to FIG. 14, the mentioned swinging device 10 possesses a lighting unit 3 which oscillates along the oscillating shaft 9 and emits light when given a force.

The mentioned mechanism which rolls the lighting unit includes a cavity and a round or other round-like structure 11, referring to FIG. 15, the described round or round-like structure 11 possesses a lighting unit 3 which rolls in the mentioned cavity and occurs light when given a force.

The mentioned mechanism which rotates the lighting unit includes a motor 4; the power of the motor 4 is supplied by the power source 1; when the motor gets power, it will rotate its rotating shaft 5, and make the lighting unit 3 rotating meanwhile lightening.

The mentioned mechanism which oscillates the lighting unit includes an swinging device 10, when the swinging device 10 is given a force and swings, the trigger 2 will work and so as to make the lighting unit lightening meanwhile oscillating along the oscillating shaft 9. The mentioned mechanism which rolls the lighting unit includes a lighting unit 3; it is made to be a round shaped or round-liked shaped structure 11; when this structure 11 is given a force, the mentioned trigger 2 will works so as to make the lighting unit 3 lightening and rolling; thus it can get more beautiful lighting effect than those lighting device whose lighting unit is fixed. By adjusting the shape or position or the lightening and flashing frequency of the lighting unit, it can generate more beautiful lightening effect shaped as real line-single color or colorful concentric circle, pitch arc, broken line or colorful concentric circle, pitch arc and so forth.

DETAILED DESCRIPTION OF THE PREFERRED EMBODIMENT

The lighting device provided by this invention, comprising a power source 1, a trigger 2 and a lighting unit 3, wherein the power source 1 supplies power to the lighting unit 3 via the trigger 2. This lighting device also includes a mechanism which rotates, oscillates or rolls the lighting unit 3.

The following Embodiment can implement the mentioned lighting device of this invention preferably, but they are not used for restricting the scope of this invention.

Embodiment 1

Figure 6:
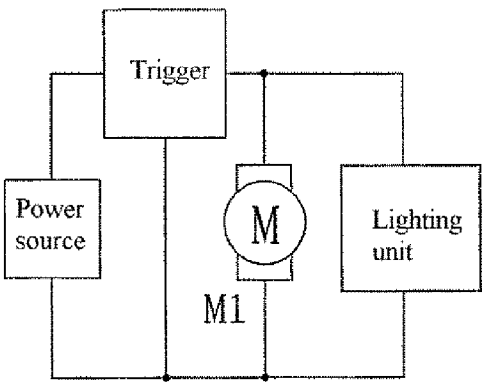
FIG. 6. is a block diagram of the circuitous philosophy of the lighting device of this invention.

As shown in FIG. 6, the mentioned lighting circuit device includes a power source 1, a trigger 2, and a lighting unit 3; wherein the power source 1 supplies power to the lighting unit 3 via the trigger 2; and it also includes a motor 4 which is connected in parallel to the mentioned lighting unit 3.

Figure 3:
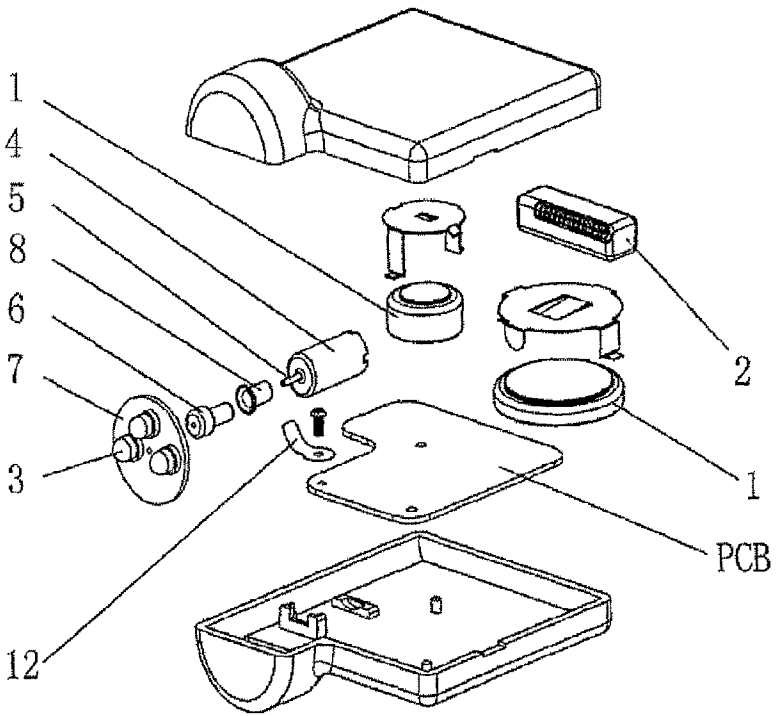
FIG. 3. is the exploded view of the Embodiment 1 of this invention.
Figure 1:
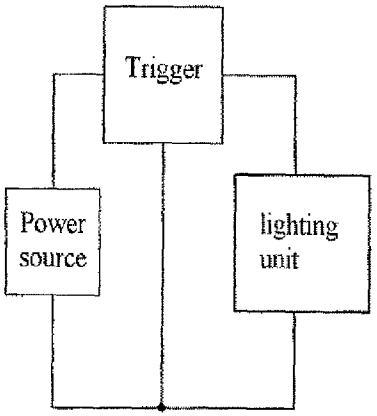
FIG. 1. is a block diagram of the circuitous philosophy of the existing lighting device.
Figure 2:
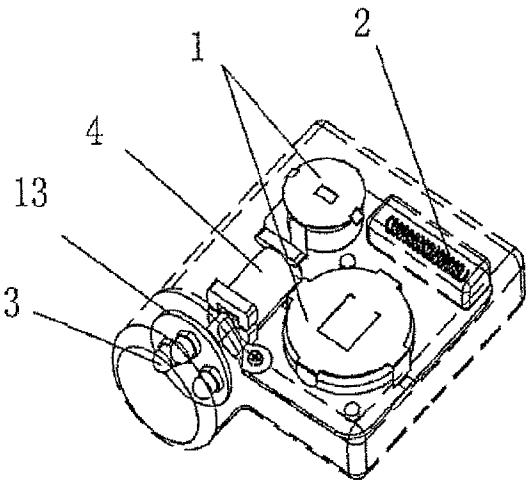
FIG. 2. is the stereoscopic view of the Embodiment 1 of this invention, wherein, the crust of the invention is hidden.

FIG. 2 is the stereoscopic view of this Embodiment; FIG. 3 is the exploded view of this Embodiment. As shown in these figures, a PCB is installed on the bottom shell of the lighting device of this invention. The connection relationship between the power source 1, the trigger 2 and the lighting unit 3 is shown in FIG. 6; in the circuit, the motor 4 is connected in parallel to the lighting unit 3. A connecting shaft 6 is installed on the transmission shaft 5 of the motor 4 which is supplied by the power source 1; the connecting shaft 6 is connected to a rotating tray 7 on which the lighting unit 3 is installed, the connecting shaft 6 is ringed by a metal ring 8. Once the metal ring 8 or one end of a connecting shaft 6 contacts the rotating tray 7, the electrocircuit of the lighting unit is put through. An electrical brush (12) is set on the corresponding position where the connection shaft 6 or metal ring 8 locates; the electrical brush 12 is a flexible parts, it puts through the electrical circuit between the lighting unit and the power source via the electrocircuit on the PCB 13.

Figure 5:
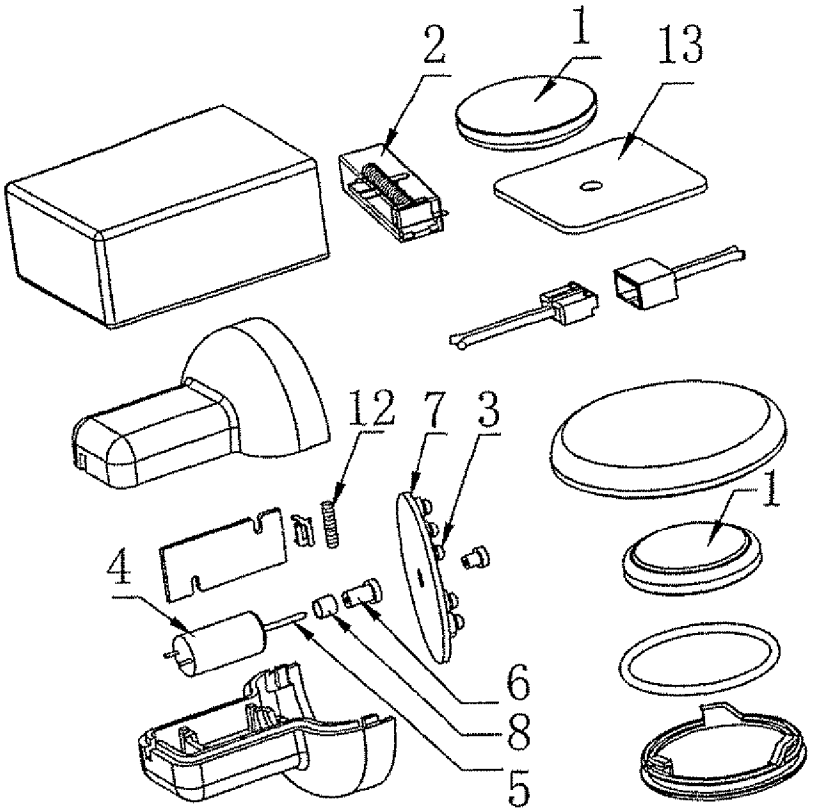
FIG. 5. is another exploded view of the Embodiment 1 of this invention.
Figure 4:
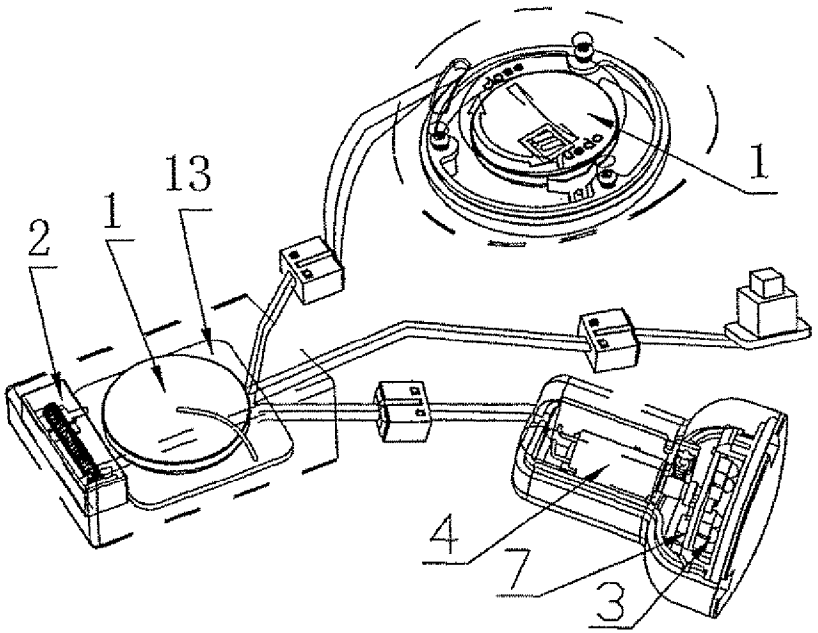
FIG. 4. is another stereoscopic view model of the Embodiment 1 of this invention, wherein, the crust of the invention is hidden.

FIG. 4 is another stereoscopic view of this invention; FIG. 5 is another exploded view of this invention. As shown in these two figures, a PCB 13 is installed on the bottom shell of the lighting device of this invention; a power source 1 and a trigger 2 are installed on the PCB 13, respectively; the motor 4, the lighting unit 3 is independently fixed on another shell; the connect relationship between the power source 1 and the trigger 2 is shown in FIG. 6; The motor 4 connects with the lighting unit 3 in parallel in the circuit. A connecting shaft 6 is installed on the transmission shaft 5 of the motor 4 which is supplied by the power source 1; the connecting shaft 6 is connected to a rotating tray 7 on which the lighting unit 3 and the trigger 2 are installed, the connecting shaft 6 is ringed by a metal ring 8. Once the metal ring 8 or one end of a connecting shaft 6 contacts the rotating tray 7, the electrocircuit of the lighting unit is put through. An electrical brush (12) is set on the corresponding position where the connection shaft 6 or metal ring 8 locates; the electrical brush 12 is a flexible parts, it puts through the electrical circuit between the lighting unit and the power source via the electrocircuit on the PCB 13.

The above mentioned motor 4 is a DC (direct current) motor, it can be a bidirection motor and can also be a unidirection motor; the lighting unit 3 can be an LED (light-emitting diode) with any color and can also be other controllable object.

Once the motor 4 gets power from the power source 1, it will rotate the rotating shaft and take the rotating tray rotating and further take the lighting unit which is fixed on the rotating tray rotating. Therefore, it can get more beautiful lighting effect than those lighting device with a fixed lighting unit. By adjusting the shape or position or the lightening and flashing frequency of the lighting unit, it can occur more beautiful lightening effect shaped as real line-single color or colorful concentric circle, pitch arc, broken line or colorful concentric circle, pitch arc etc.

Figure 9:
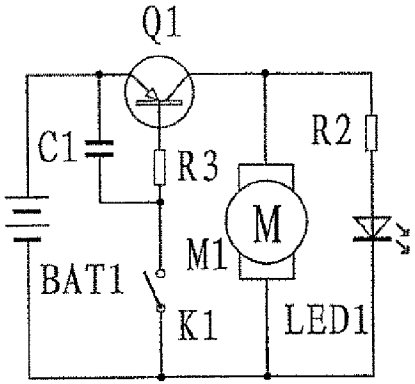
FIG. 9. is a kind of circuit diagram to implement this invention.
Figure 8:
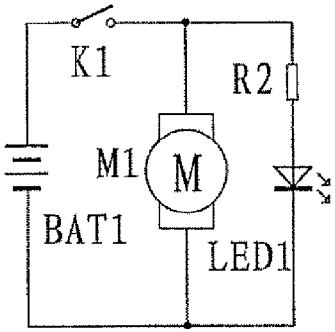
FIG. 8. is a kind of circuit diagram to implement this invention.

The block diagram of the circuitous philosophy is shown in FIG. 6; it can be implemented by the idiographic circuit shown in FIG. 8 and FIG. 9.

The first circuit connection mode of the lighting device of this invention, as shown in FIG. 8, comprising a power source BAT1, a trigger switch K1, a current-limiting resistor R2 and a light-emitting diode LED1; the power source BAT1 supplies the lighting unit via K1, the mentioned lighting unit is composed of the resistor R2 and the light-emitting diode LED1 which connect in series; the cathode of the light-emitting diode LED1 is earthling. There is a motor M1 is connected to the node which locates between the trigger switch K1 and the resistor R2. When the trigger switch is separated, the lighting device will not emit light; when the trigger switch is shut, the motor will get power and run. Due to the mentioned light-emitting diode and the rotating shaft of the motor are fixed together in a certain mode, the running of the motor can make the light-emitting diode rotating along the rotating shaft, so as to get lightening effect which shaped like a round.

The second circuit connection mode of the lighting device of this invention, as shown in FIG. 9, comprising a power source BAT1; a motor M1; a trigger which composed of a resistor R3, a capacitor C1, a switch K1, a dynatron Q1; and a lighting unit which composed of a current-limiting resistor R2 and a light-emitting diode LED1. The current-limiting resistor R2 is connected in series to the light-emitting diode LED1. The cathode of the light-emitting diode LED1 is earthing. The motor M1 is connected in parallel to the lighting unit. The base of the dynatron Q1 is connected to the cathode of the power source via the resistor k3 and the switch K1 in turn. The capacitor C1 is connected to the nodes which are between the anode of the power source and the resistor R3 and the switch K1. The emitter of the dynatron Q1 is connected to the anode of power source; the collector of the dynatron Q1 is connected to the current-limiting resistor R2. When the trigger switch is shut, the resistor R3 and the capacitor C1 will discharge to the earth, then the dynatron Q1 will be put through, and the motor M1 will be rotating because of getting power from the power source BAT1. Due to the mentioned light-emitting diode and the rotating shaft of the motor are fixed together in a certain mode, the running of the motor can make the light-emitting diode rotating along the rotating shaft, so as to get lightening effect which shaped like a round. This second circuit connection mode of the lighting device this invention has improved the trigger which is shown in FIG. 8. The resistor R3 and the capacitor C1 which are shown in FIG. 9 can be charged up so as to keep energy; even if the switch is separated, the dynatron Q1 will still be electriferous for quite a while. By selecting an appropriate parameter of the capacitor C1 and the dynatron Q1, we can get a control to the rotating term of the lighting unit and the motor, so as to get more lightening effect.

Figure 10:
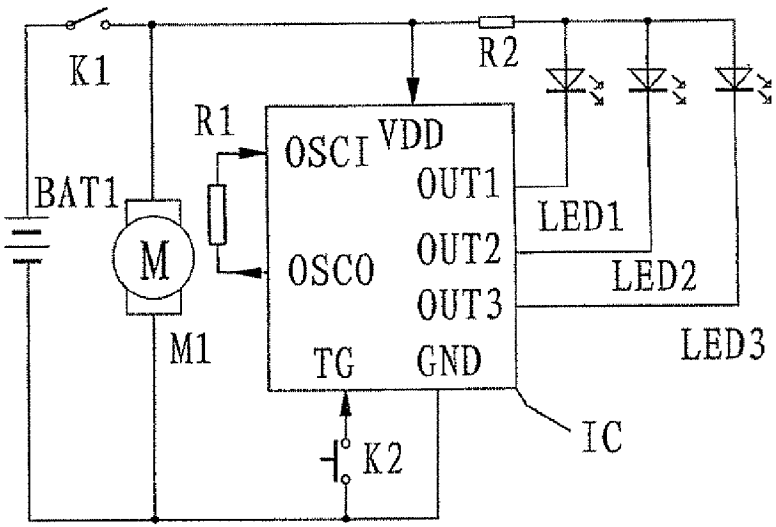
FIG. 10. is a kind of circuit diagram to implement this invention.
Figure 7:
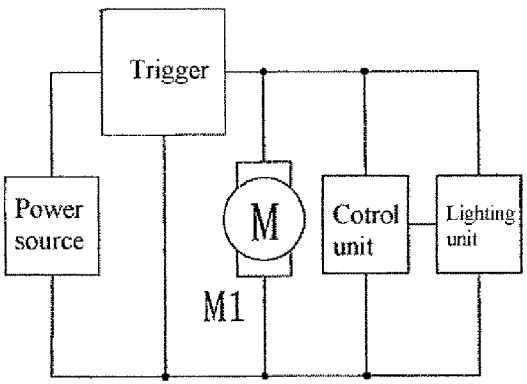
FIG. 7. is a more detailed block diagram of the circuitous philosophy of this invention.
Figure 12:
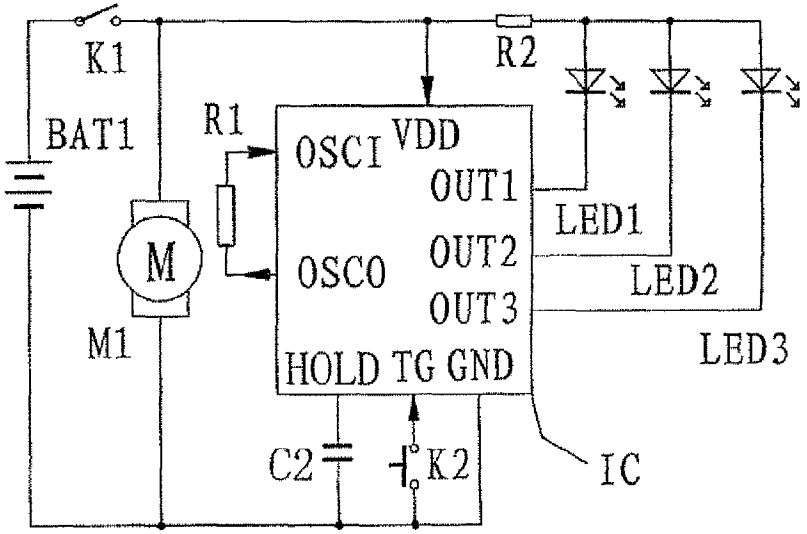
FIG. 12. is a kind of circuit diagram to implement this invention.

The block diagram of the circuitous philosophy of this invention is shown in FIG. 7; it can be implemented by the idiographic circuit shown in FIG. 10 and FIG. 12.

The third circuit connection mode of the lighting device of this invention is shown in FIG. 10. In this connection mode, the lighting unit is different from the first connection mode. This lighting unit is composed of a control IC, a oscillate resistor R1, two trigger switches K1 and K2, a current-limiting resistor R2, and light-emitting diodes LED1,LED2, LED3. R1 is connected to the OSCI end and OSCO end of the control IC. The cathodes of LED1,LED,LED3 are connected to the output ends OUT1,OUT2,OUT3, respectively; the anodes of these three LEDs are together connected to K1 via the current-limiting resistor R2. When K1 is separated, the lighting device will not emit light; when K2 is shut, the motor will get power and run. Due to that the mentioned lighting unit and the rotating shaft of the motor are fixed together in a certain mode, and that a control IC is added to this circuit for controlling the LEDs, the lightening of the LEDs could be controlled by controlling the predetermined lightening mode of the control IC, so to make the LEDs generate more lightening effect.

Figure 11:
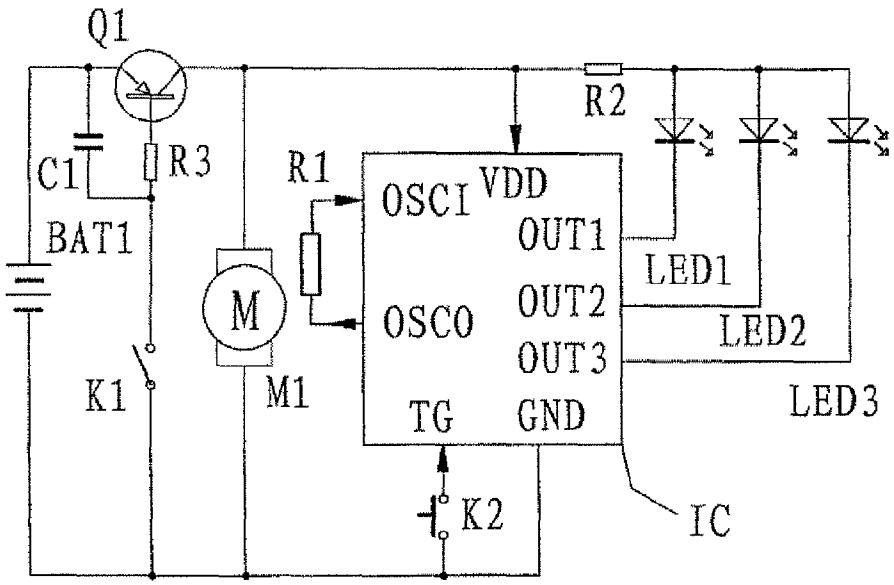
FIG. 11. is a kind of circuit diagram to implement this invention.

The fourth circuit connection mode of the lighting device of this invention is shown in FIG. 11. It uses the trigger of the second connection mode and the lighting unit of the third mode to replace the corresponding parts of the first connection, so it have the functions of all the above three connection modes, and can occur more lighting effects.

The fifth circuit connection mode of the lighting device of this invention is shown in FIG. 12. It adds a pins HOLD to the control IC of the third connection mode for connecting the energy storage element. Here a capacitor is used as the energy storage element; and the capacity of this capacitor is proportional to the term of the energy maintenance. Because such a small portion of circuit which inside the control IC for keeping energy consumes very little energy, it could maintain the components in the circuit being electriferous for quite a long term, so as to make the flash being continuous, further to solve the technical problems that issued by the above mentioned invention purposes. Added to the function of possessing the characteristics of the third connection mode, this fifth circuit connection mode is under the control of the control IC to implement the functions such as keeping the flash when power interrupted, so as to get more lighting effects.

Although the quantity of the LEDs is different in each of the above five connection mode, here it just for a better description and cannot be thought to be a restrict for the LED's quantity. Due to the LEDs are fixed on the rotating shaft and rotate along the shaft, it can get variety lighting effects by properly arranging the positions of the LEDs. For example, it will get several different size lighting circles which shaped as round when arranging the LEDs on the circumferences of each different sized circle centered on the rotating shaft; and it will get several flowing lighting circles if the control IC transmits the signals to the LEDs in different turn; it will of course get more lighting effects by changing the signal transmitting mode of the control IC. If distributing the LEDs with different colors on different positions of the circumference of a certain radius circle centered on the rotating shaft, and due to the rotating of the motor plus the flash lingering effect of people, it will be seen as a colorful lighting circle image which is different from the former single color one. Of course that the above mentioned connection modes are only part of the application of this invention, so long as one connection mode is an equivalent substitution for anyone of the above mentioned connection modes, it belongs to the protection scope of this invention.

Figure 13:
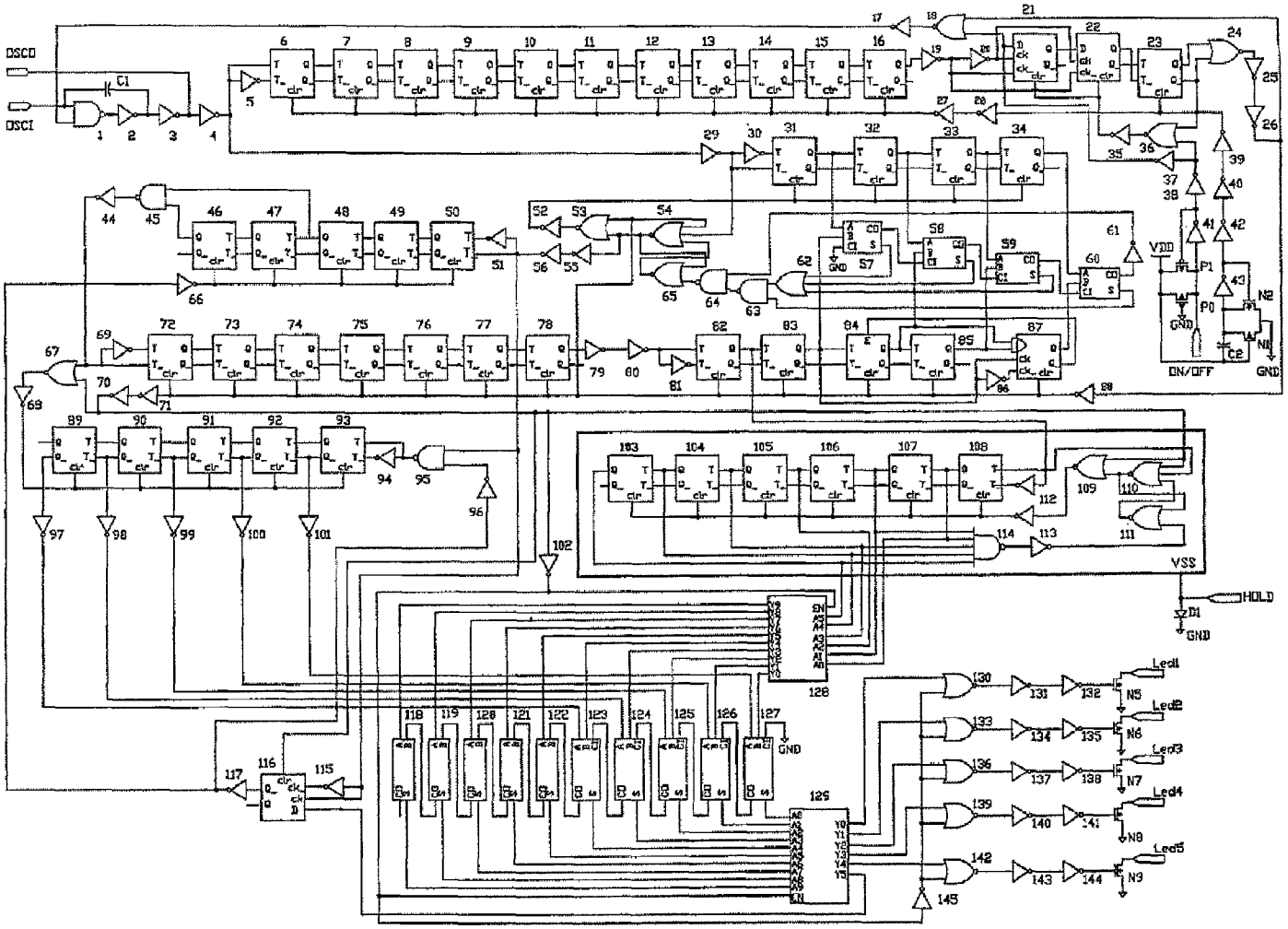
FIG. 13. is the circuit diagram of the internal circuit of the control IC of this invention.

Referring now to FIG. 13, an embodiment of the control IC of this invention is shown. Being different from the common Control IC, the logic earth VSS of the organ 103-114 which for controlling flash mode in this Control IC is independent; the logic earth VSS is connected and isolated to the system earth GND via an isolation component; the isolation component may be a diode (D1); the diode's anode is connected to the logic earth VSS; the logic earth VSS is connected to the outside of the control IC by a pins HOLD in order to connect the energy storage element; Here a capacitor is used as the energy storage element; and the capacity of this capacitor is proportional to the term of the energy maintenance. Because such a small portion of circuit which inside the control IC for keeping energy consumes very little energy, it could maintain the components in the circuit being electriferous for quite a long term, so as to make the flash being continuous, further to solve the technical problems that issued by the above mentioned invention purposes. In addition, because there is a LED D1 between the logic earth VSS and the system earth GND, the reference electrical level of this circuit portion will be different from the rest circuit, in this way, abnormal phenomenon may occurs when the system voltage is too low; to solve such a problem, it only needs a electrical level matcher adding between this portion and the rest portion of the circuit.

The above mentioned control IC possesses pins HOLD connects the energy storage element, so as to make the power source of the portion which for controlling flash mode of the control IC is independent from the system power source; the control IC may be supplied power by a energy storage element such as a capacitor C2 when the system power is interrupted, so as to keep the state of the component which for controlling the current flash mode and to get more flash effects; although here the capacitor C2 is connected between the pins HOLD and the cathode of the power source to implement this function, the capacitor C2 can also be connected between the pins HOLD and the anodes of the power source so long as the circuit changed a little bit; such changes are obvious to the common technicists in this field. In addition, the above mentioned isolation component is actually a simple PN knot; here not only a LED can be used as the isolation component, but also a dynatron or other equal component can be used and also have the same function.

Embodiment 2

Figure 14:
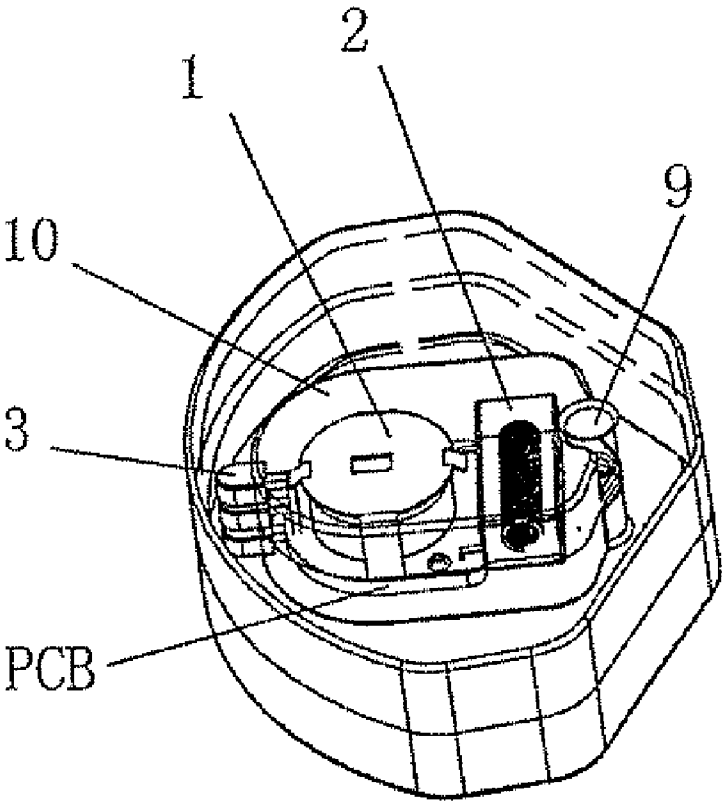
FIG. 14. is the stereoscopic view of the Embodiment 2 of this invention, wherein, the crust of the invention is hidden.

FIG. 14. is the stereoscopic view of this Embodiment 2 of this invention. As shown in this fig, there is an swinging device 10 and an oscillating shaft 9. The mentioned swinging device 10 includes a power source 1, a trigger 2 and a lighting unit 3, wherein the power source 1 supplies the lighting unit 3 via the trigger 2. When the swinging device 10 is given a force and oscillates, the trigger 2 will work and so as to make the lighting unit lightening meanwhile oscillating along the oscillating shaft 9; thus it can get more beautiful lighting effect than those lighting device whose lighting unit is fixed. By adjusting the shape or position or the lightening and flashing frequency of the lighting unit, it can generate more beautiful lightening effect shaped as real line-single color or colorful concentric circle, pitch arc, broken line or colorful concentric circle, pitch arc and so forth.

Embodiment 3

Figure 15:
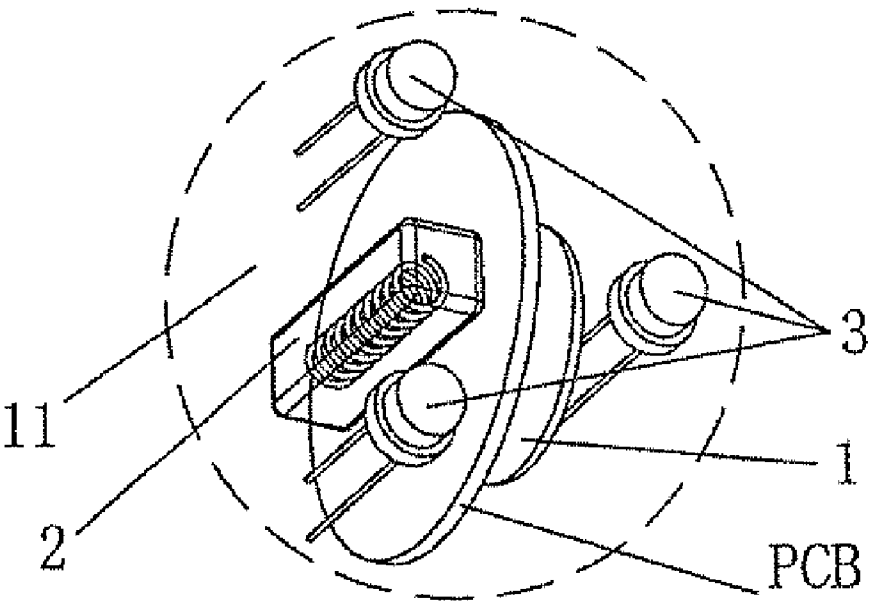
FIG. 15. is the stereoscopic view of the Embodiment 3 of this invention, wherein, the crust of the invention is hidden.

FIG. 15. is the stereoscopic view of this Embodiment 3 of this invention. The rotating mechanism includes a power source 1, a trigger 2 and a lighting unit 3. The power source 1, the trigger 2 and the lighting unit 3 are integrated together to be a round shaped or round-liked shaped structure 11. When this structure 11 is given a force, the mentioned trigger 2 will work so as to make the lighting unit 3 lightening and rolling; thus it can get more beautiful lighting effect than those lighting device whose lighting unit is fixed. By adjusting the shape or position or the lightening and flashing frequency of the lighting unit, it can generate more beautiful lightening effect shaped as real line-single color or colorful concentric circle, pitch arc, broken line or colorful concentric circle, pitch arc and so forth.

Embodiment 4

In this Embodiment 4, the motor and the lighting unit independently possess their own power source. To realize the effect of this Embodiment 3, it just needs a little bit changes of the circuits in the above Embodiments.

The power source which mentioned in the each of the above four Embodiments of this invention can be a single battery or some Li—Mn batteries connected in series, or some alkali-Mn batteries connected in series, or some Li—Mn batteries and alkali-Mn batteries connected in series, or rechargeable batteries, or solar batteries. Normally the voltage of single Li—Mn battery is 3 V due to its special stuff property, so the voltage of the Li—Mn batteries connected in series is above or equal 6 V. The common models of the Li—Mn batteries are like CR2032, CR2450 and other CR series batteries. In a same way, the voltage of single alkali-Mn battery is 1.5 V due to its special stuff property. The common models of the alkali-Mn batteries are like AG13, AG10 and other AG series batteries. In each of the above four Embodiments of this invention, only when the circuit voltage is above 1.5 v, the circuit can work ordinary, namely the LED can emit light ordinary; so the alkali-Mn batteries here must be used in series in order to make sure that the voltage of the circuit above 1.5 V. In a similar way, the alkali-Mn battery and the Li—Mn battery must also be connected in series if they are used together, that also due to their special stuff properties.

We claim:

1. A lighting device, comprising a power source, a trigger, and a lighting unit, wherein the power source supplies power to the lighting unit via the trigger, wherein the trigger comprises a dynatron, a capacitor, a resistor, and a switch, wherein the dynatron is powered by the power source for directing the lighting unit when the switch is shut, and wherein the capacitor is charged up when the switch is shut such that the charged up capacitor can temporarily supply power to the dynatron when the switch is subsequently opened; and wherein the lighting device further includes a mechanism that rotates, oscillates, or rolls the lighting unit, wherein the mechanism that rotates the lighting unit includes a motor, wherein the motor includes a rotating shaft that is connected to the lighting unit a part of the lighting unit; and wherein the lighting unit is connected to a control unit, wherein the lighting unit comprises a current-limiting resistor and a light-emitting diode, wherein the current-limiting resistor is connected in series to the light-emitting diode, and a cathode of the light-emitting diode is grounded, wherein the motor is connected in parallel to the lighting unit, wherein a base of the dynatron is connected to a cathode of the power source via the resistor and the switch, wherein the capacitor connects an anode of power source and a node located between the resistor and the switch, wherein an emitter of the dynatron is connected to the anode of the power source, wherein a collector of the dynatron is connected to the current-limiting resistor, and wherein the light-emitting diode and the rotating shaft are fixed together by a fixture used for setting the lighting unit or the part of the lighting unit.

2. The lighting device of claim 1 wherein the rotating shaft has a connecting shaft; wherein the connecting shaft is connected to a rotating tray on which the lighting unit is installed, wherein the connecting shaft is ringed by an electric metal ring; and wherein once the metal ring or one end of the connecting shaft contacts the rotating tray, an electrocircuit of the lighting unit is enabled.

3. The lighting device of claim 1 further comprising a PCB board; wherein an electrocircuit of the lighting unit is integrated on the PCB board, wherein on the PCB board, an electrical brush is set on a corresponding position where the connecting shaft or metal ring is located; wherein the electrical brush is a flexible part that completes a connection between the lighting unit and the power source via the electrocircuit on the PCB board.

4. The lighting device of claim 1 wherein the control unit includes a control IC, wherein a second trigger of the control IC and a logic ground (VSS) of a NAND gate are connected by a system ground (GND) via an isolation component that is made by a diode having an anode and a cathode; wherein the anode is connected to the logic ground (VSS) and the cathode is connected to the system ground (GND); and wherein the logic ground (VSS) is connected to the outside of the control IC by a pin (HOLD).

5. The lighting device of claim 1 wherein the motor is a direct current (DC) motor that is bidirectional or monodirectional; wherein the lighting unit has at least an LED of any color.

6. The lighting device of claim 1 wherein the mechanism that oscillates the lighting unit includes a swinging device with an oscillating shaft; wherein the swinging device includes the lighting unit that oscillates along the oscillating shaft and emits light when given a force.

7. The lighting device of claim 1 wherein the mechanism that rolls the lighting unit includes a cavity and a round or round-like structure, wherein the round or round-like structure includes the lighting unit which rolls in the mentioned cavity and emits light when given a force.

8. The lighting device of claim 1 wherein the power source comprises one or more batteries.

9. The lighting device of claim 8 wherein the power source comprises one or more Li—Mn batteries, alkali-Mn batteries, rechargeable batteries, or solar batteries.

10. The lighting device of claim 9 wherein the power source comprises (i) a plurality of Li—Mn batteries connected in series, (ii) a plurality of alkali-Mn batteries connected in series; or (iii) at least one Li—Mn battery and at least one alkali-Mn battery connected in series.

11. A lighting device, comprising a power source, a trigger, and a lighting unit, wherein the power source supplies power to the lighting unit via the trigger, wherein the trigger comprises a dynatron, a capacitor, a resistor, and a switch, wherein the dynatron is powered by the power source for directing the lighting unit when the switch is shut, and wherein the capacitor is charged up when the switch is shut such that the charged up capacitor can temporarily supply power to the dynatron when the switch is subsequently opened; and wherein the lighting device further includes a mechanism that rotates, oscillates, or rolls the lighting unit, wherein the mechanism that rotates the lighting unit includes a motor, wherein the motor includes a rotating shaft that is connected to the lighting unit a part of the lighting unit; and wherein the lighting unit is connected to a control unit, wherein the lighting unit comprises a current-limiting resistor and a plurality of light-emitting diodes, wherein respective cathodes of the plurality of light-emitting diodes are connected to respective output ends of the control IC, wherein respective anodes of the plurality of light-emitting diodes are connected to a collector of the dynatron via the current-limiting resistor, wherein a base of the dynatron is connected to a cathode of the power source via the resistor and the trigger switch, wherein the capacitor connects an anode of power source and a node located between the resistor and the switch, wherein an emitter of the dynatron is connected to the anode of the power source, wherein a collector of the dynatron is connected to the current-limiting resistor, and wherein the motor connects ground and the node, and wherein the plurality of light-emitting diodes and the rotating shaft are fixed together by a fixture used for setting the lighting unit or part of the lighting unit.

12. The lighting device of claim 11 wherein the rotating shaft has a connecting shaft; wherein the connecting shaft is connected to a rotating tray on which the lighting unit is installed, wherein the connecting shaft is ringed by an electric metal ring; and wherein once the metal ring or one end of the connecting shaft contacts the rotating tray, an electrocircuit of the lighting unit is enabled.

13. The lighting device of claim 11 further comprising a PCB board; wherein an electrocircuit of the lighting unit is integrated on the PCB board, wherein on the PCB board, an electrical brush is set on a corresponding position where the connecting shaft or metal ring is located; wherein the electrical brush is a flexible part that completes a connection between the lighting unit and the power source via the electrocircuit on the PCB board.

14. The lighting device of claim 11 wherein the control unit includes a control IC, wherein a second trigger of the control IC and a logic ground (VSS) of a NAND gate are connected by a system ground (GND) via an isolation component that is made by a diode having an anode and a cathode; wherein the anode is connected to the logic ground (VSS) and the cathode is connected to the system ground (GND); and wherein the logic ground (VSS) is connected to the outside of the control IC by a pin (HOLD).

15. The lighting device of claim 11 wherein the motor is a direct current (DC) motor that is bidirectional or monodirectional; wherein the lighting unit has at least an LED of any color.

16. The lighting device of claim 11 wherein the mechanism that oscillates the lighting unit includes a swinging device with an oscillating shaft; wherein the swinging device includes the lighting unit that oscillates along the oscillating shaft and emits light when given a force.

17. The lighting device of claim 11 wherein the mechanism that rolls the lighting unit includes a cavity and a round or round-like structure, wherein the round or round-like structure includes the lighting unit which rolls in the mentioned cavity and emits light when given a force.

18. The lighting device of claim 11 wherein the power source comprises one or more batteries.

19. The lighting device of claim 11 wherein the power source comprises one or more Li—Mn batteries, alkali-Mn batteries, rechargeable batteries, or solar batteries.

20. The lighting device of claim 19 wherein the power source comprises (i) a plurality of Li—Mn batteries connected in series, (ii) a plurality of alkali-Mn batteries connected in series; or (iii) at least one Li—Mn battery and at least one alkali-Mn battery connected in series.

* * * * *